US006364771B1

(12) United States Patent
Lee

(10) Patent No.: US 6,364,771 B1
(45) Date of Patent: Apr. 2, 2002

(54) HANDHELD ELECTRONIC GAME APPARATUS HAVING ATTACKING FEATURE

(75) Inventor: Sam Y. Lee, Torrance, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/501,870

(22) Filed: Feb. 10, 2000

(51) Int. Cl.[7] ..... A63F 13/00
(52) U.S. Cl. ..... 463/46; 463/38; 273/148 B
(58) Field of Search ..... 273/148 R, 148 B, 273/454, 460; 463/30, 36, 37, 38, 46, 47, 43, 44

(56) References Cited

U.S. PATENT DOCUMENTS

| | | | | | |
|---|---|---|---|---|---|
| 4,359,222 | A | * | 11/1982 | Smith, III et al. | 463/44 |
| 4,568,307 | A | | 2/1986 | Gabler et al. | |
| 4,793,610 | A | * | 12/1988 | Moomaw et al. | 273/454 |
| 5,184,830 | A | * | 2/1993 | Okada et al. | 463/44 |
| 5,213,327 | A | * | 5/1993 | Kitaue | 273/148 B |
| D336,665 | S | | 6/1993 | Tugendhaft | |
| 5,224,711 | A | | 7/1993 | Dresser | |
| 5,435,566 | A | | 7/1995 | Scuderi | |
| 5,464,214 | A | | 11/1995 | Griffin | |
| D397,729 | S | | 9/1998 | Schulz et al. | |
| D399,268 | S | | 10/1998 | Liu | |
| 5,855,483 | A | | 1/1999 | Collins et al. | |
| 5,893,798 | A | | 4/1999 | Stambolic et al. | |
| 5,967,898 | A | * | 6/1999 | Takasaka et al. | 463/37 |
| 5,976,018 | A | * | 11/1999 | Druckman | 463/47 |
| 6,083,104 | A | * | 7/2000 | Choi | 463/6 |
| 6,125,032 | A | * | 9/2000 | Gillespie | 273/148 R |
| 6,193,609 | B1 | * | 2/2001 | D'Archard Van Enschut | 463/37 |
| 6,200,219 | B1 | * | 3/2001 | Rudell et al. | 463/37 |
| 6,213,871 | B1 | * | 4/2001 | Yokoi | 463/7 |
| 6,248,017 | B1 | * | 6/2001 | Roach | 463/37 |

* cited by examiner

*Primary Examiner*—Michael O'Neill
(74) *Attorney, Agent, or Firm*—Roy A. Ekstrand

(57) ABSTRACT

A game play apparatus housing supports a joystick post and a plurality of game play input buttons. A miniature surfboard is supported on the upper end of the joystick post. A microprocessor game play circuit and sound circuit together with a controller is supported within the interior of the housing. A simulated shark head is pivotally supported upon the upper end of the housing and forms an upper jaw. A drive mechanism utilizing a reversible motor responds to the controller circuit to either oscillate the head and upper jaw through a narrow range of motion or, alternatively, allow a rapid downward closure of the upper jaw upon the toy surfboard to provide a game play finale.

9 Claims, 2 Drawing Sheets

HANDHELD ELECTRONIC GAME APPARATUS HAVING ATTACKING FEATURE

FIELD OF THE INVENTION

This invention relates generally to handheld game play apparatus and particularly to the game ending feature thereof.

BACKGROUND OF THE INVENTION

With the rapid development of relatively low cost, digital electronic devices including low cost microprocessors and memory devices, a substantial number of different toys and games were developed. One type of electronic game which enjoyed great popularity as low cost digital electronic apparatus continued to develop became generally known in the art as "handheld" games. Such games derive their name from the relatively small size of the housing used to package the game. These devices are, in essence, small enough to be held by the user either in the hand or upon a game play surface such as a table. While various shapes, configurations and sizes of handheld electronic games have been provided, the basic handheld electronic game utilizes a housing, usually small enough to be held, within which a digital electronic circuit including a microprocessor and associated memory is supported together with a plurality of batteries. The housing typically supports a plurality of input buttons or other devices used in game play. Also, within the housing, a sound circuit and sound producing transducer such as a small speaker or piezoelectric device is supported. The typical handheld electronic game also utilizes a small display screen upon which images may be formed. The most frequently used technology for such screens is found in a plurality of liquid crystal display cells or "LCD's". Some handheld games, however, also utilize light emitting diode or "LED" display screens.

The basic game play rules which are used by the microprocessor in playing the game, controlling the displayed images, and responding to user inputs during game play are typically stored in the microprocessor memory. Handheld electronic games are often configured for play by a single user in which the player is, in essence, playing against the microprocessor within the device. Alternatively, competitive handheld electronic games have been provided which allow two or more players to compete in game play.

In most modern handheld electronic games, interest and amusement is increased by the provision of a dramatic climax at the end of game play indicating either a win or a loss. Such dramatic sequences usually involve the output of dramatic sounds and appropriate images on the display.

With the customary high degree of competition existing between toy manufacturers and toy developers, a continuing effort has been expended to further improve the play value and amusement of handheld electronic games. Notsurprisingly, these efforts have included attempts to expand the play objects and utilities of handheld electronic games. For example, U.S. Pat. Des. No. 336,665 issued to Tugendhaft sets forth a COMBINED TOY PLANE AND VIDEO GAME having a housing generally configured to represent a fanciful airplane. The housing includes a support base upon which the airplane fuselage is pivotally supported. The airplane fuselage is pivoted upwardly to expose a display device on the base of the housing and to facilitate game play. With the fuselage closed upon the housing, a toy airplane for conventional play is provided.

U.S. Pat. Des. No. 397,729 issued to Schulz, et al. sets forth a HAND HELD ELECTRONIC FISHING GAME having a housing shaped to generally replicate a fish. The housing supports a display element and a plurality of input devices. The housing further supports a rotatable winding handle of the type typical of conventional fishing reels.

U.S. Pat. Des. No. 399,268 issued to Liu sets forth a VIDEO GAME having a housing resembling a fish upon which a display device is supported. A plurality of input buttons are supported on the housing about the image device.

U.S. Pat. No. 5,893,798 issued to Stambolic, et al. sets forth HAND-HELD ELECTRONIC GAME DEVICES employing push-buttons and other controls to manipulate game play and action on an electronic display. The device is housed in a cylindrical housing having a facet which supports a display device.

U.S. Pat. No. 5,464,214 issued to Griffin sets forth a DEVICE FOR ENHANCING THE APPEAL OF A VIDEO TERMINAL having the head and feet of a fanciful animal character supported above the monitor and keyboard of a conventional video terminal.

U.S. Pat. No. 5,855,483 issued to Collins, et al. sets forth INTERACTIVE PLAY WITH A COMPUTER having a remote station operable by a child user linked to a computer by a radio transmitter and receiver. The game play commands are transmitted to and from the remote unit by the radio frequency transmission link.

Examples of board games utilizing a surfing or aquatic play pattern are set forth in U.S. Pat. No. 5,435,566 issued to Scuderi and U.S. Pat. No. 5,224,711 issued to Dresser.

U.S. Pat. No. 4,568,307 issued to Gabler, et al. sets forth a PUSH TOY VEHICLE WITH OPERABLE MOUTH having a small push toy generally resembling a toy vehicle which supports a pivotally secured mouth at the forward end of the toy vehicle. The mouth is provided with upper and lower jaws and is actuated between open and closed positions by a mechanism within the toy.

While the foregoing described prior art devices have to some extent improved the art and have in some instances enjoyed commercial success, there remains nonetheless a continuing need in the art for evermore improved, interesting and amusing handheld electronic game apparatus.

SUMMARY OF THE INVENTION

Accordingly, it is a general object of the present invention to provide an improved handheld electronic game apparatus. It is a more particular object of the present invention to provide an improved handheld electronic game apparatus which includes a novel and dramatic attacking feature for game play climax.

In accordance with the present invention, there is provided game play apparatus comprising: a housing defining an interior cavity and an upper portion; a closure member pivotably supported by the upper portion, the closure member pivotable between an open position and a closed position; a joystick game play switch mechanism supported by the housing and having an upwardly extending joystick post supporting a finger-touch game play element; drive means within the interior cavity coupled to the closure member constructed to pivotally oscillate the closure member at the open position and to rapidly move the closure member from the open position to the closed position in close proximity to the finger-touch game play element; and a game play controller responsive to the joystick game play mechanism to cause the drive means to pivotally oscillate the closure member and thereafter move the closure member to the closed position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
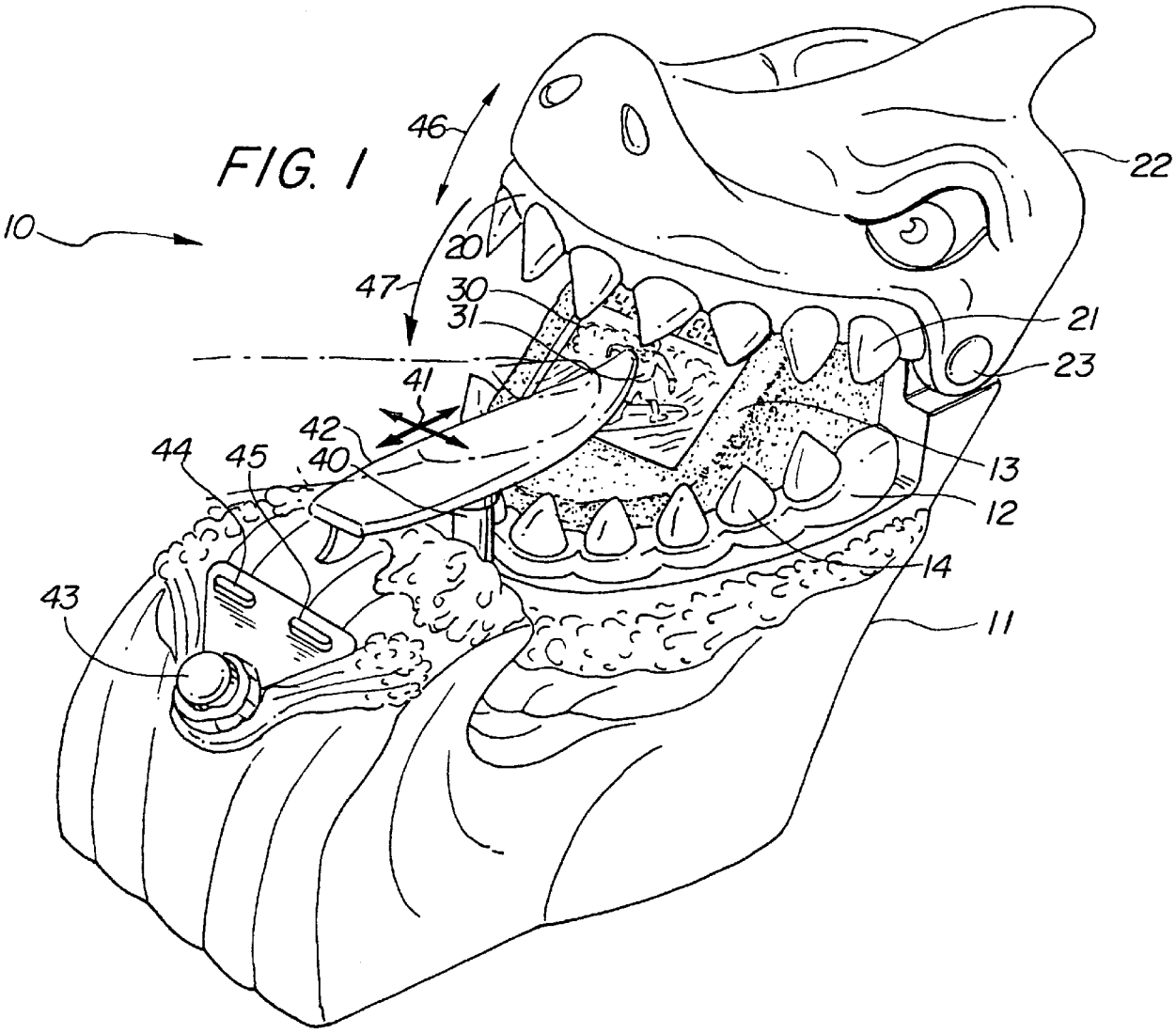
FIG. 1 sets forth a perspective view of a handheld electronic game apparatus constructed in accordance with the present invention.

FIG. 1 sets forth a perspective view of a game apparatus constructed in accordance with the present invention and generally referenced by numeral 10. Game apparatus 10 includes a housing 11 preferably formed of a molded plastic material or the like. Housing 11 includes a simulated lower jaw 12 and mouth interior 13 together with a plurality of simulated lower teeth 14. Housing 11 further supports a plurality of user input game controls including a button 43 and a pair of side buttons 44 and 45. Game apparatus 10 further includes a head 22 which is shaped to generally resemble a fierce version of a shark head or the like. Head 22 is pivotally supported upon housing 11 by a pivot 23 in the manner shown in FIG. 2. Head 22 further defines an upper jaw 20 having a plurality of upper teeth 21 extending downwardly therefrom. A display 30, which may for example comprise a liquid crystal display combination, is supported within mouth interior 13 and is used to form game play images such as image 31.

In further accordance with the present invention, housing 11 supports a joystick post 40 having an upper end which supports a miniature toy surfboard 42. By means set forth below in greater detail, joystick post 40 and toy surfboard 22 are movable in four directions as indicated by arrows 41.

In operation, the user initiates game play by pressing button 43 and makes game play selections using buttons 44 and 45. Thereafter, the user places a finger as shown in phantom depiction upon toy surfboard 42 and "surfs" by manipulating toy surfboard 42. In the preferred fabrication of the present invention, image 31 upon display 30 responds to the various control inputs provided by the operation of joystick post 40 and toy surfboard 42. The operation of the game play apparatus within housing 11 may be fabricated in accordance with conventional fabrication techniques to provide a set of game play rules which incorporates the joystick input provided by joystick post 40 described below.

In accordance with an important aspect of the present invention, the mechanism set forth below in FIGS. 2 and 3 operates during the game play interval to move head 22 about pivot 23 in a small angle oscillation up and down as indicated by arrows 46. This jaw movement of head 22 provides an interesting and amusing ominous characteristic for the simulated shark provided by head 22, upper jaw 20 and lower jaw 12. As the user continues game play, the manipulation of toy surfboard 42 continues. At some point, the game play apparatus within housing 11 (shown in FIG. 2) reaches a climax point in which the game play is to end. In accordance with the present invention, the operative mechanism within game apparatus 10 participates in a losing climax under the game rules by rapidly closing upper jaw 20 and head 22 downwardly upon the user's finger and toy surfboard 42 in a full downward movement as indicated by arrow 47.

In the theme used in the embodiment of the present invention game apparatus shown in FIG. 1, it is anticipated and preferred that the game play image upon display 30 as well as the physical appearance of head 22 and upper jaw 20 together with lower jaw 12 are coordinated to accommodate the surfing and shark attack theme of the game apparatus shown in FIG. 1. However, it will be apparent to those skilled in the art that the present invention game apparatus may be suitably themed using other types of game play themes without departing from the spirit and scope of the present invention. Thus, different game play themes may be utilized in which toy surfboard 42 is replaced by an alternate pedestal for finger placement and in which lower jaw 12, head 22 and upper jaw 20 are given a different appearance to be consistent with an alternate theme. For example, head 22 and upper jaw 20 together with lower jaw 12 may be given an appearance which represents a large hand or claw reaching forwardly and closing upon an alternative object replacing surfboard 42 such as jewel, coin, or even a cookie. A variety of alternative themes may be envisioned which utilize the basic elements of the present invention game apparatus to greatly increase the excitement of game play.

Figures 2, 3:
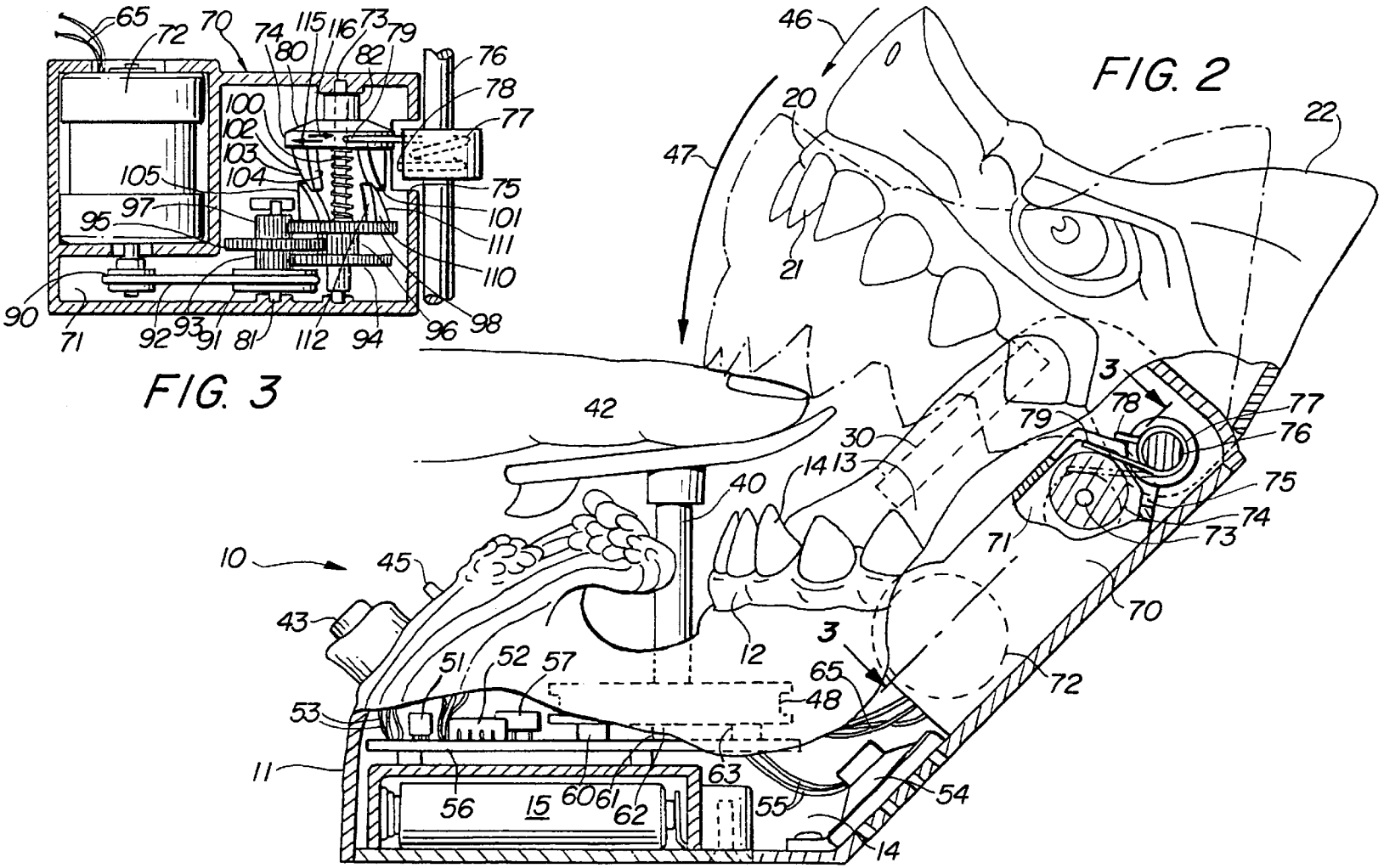
FIG. 2 sets forth a partially sectioned side elevation view of the present invention handheld electronic game apparatus.
FIG. 3 sets forth a partial section view of the operative mechanism of the present invention handheld electronic game apparatus taken along section lines 3—3 in FIG. 2.

FIG. 2 sets forth a partially sectioned side elevation view of game apparatus 10. As described above, game apparatus 10 includes a housing 11 supporting a plurality of user input buttons such as buttons 43 and 45 and further supporting a joystick post 40. As is also described above, game apparatus 10 includes a head 22 supporting an upper jaw 20 having a plurality of upper teeth 21 in a pivotal attachment to housing 11. A lower jaw 12 includes a plurality of lower teeth 14. A mouth interior 13 is formed upon the upper surface of housing 11 and supports a display device 30. Joystick post 40 supports a toy surfboard 42 which the user manipulates using a finger as shown in FIG. 2.

Housing 11 defines an interior cavity 14 within which a plurality of conventional batteries 15 together with conventional connecting terminals and apparatus are supported. A controller circuit 50 includes a conventional printed circuit board 56 supported within interior cavity 14. While not shown in FIG. 2, it will be understood that batteries 15 are coupled to controller circuit 50 utilizing conventional connecting wires. Also supported within interior cavity 15 is a speaker 54 operatively coupled to a sound circuit 57 supported upon printed circuit board 56 using a plurality of connecting wires 55. A plurality of wires 53 operatively couple buttons 43, 44 and 45 (button 45 seen in FIG. 1) to printed circuit board 56.

A conventional joystick plate 48 is operatively coupled to the lower end of joystick post 40. Joystick plate 48 operates a plurality of switches 60, 61, 62 and 63 preferably positioned upon circuit board 56 in a front-to-back and side-to-side pair arrangement. In accordance with conventional fabrication techniques, joystick plate 48 is coupled to switches 60 through 63 such that movement side-to-side actuates either of switches 61 and 62 while movement front-to-back actuates either of switches 60 and 63. Thus, the combination of joystick 40, joystick plate 48 and switches 60 through 63 will be understood to be fabricated in accordance with conventional fabrication techniques.

A drive housing 70 defining an interior cavity 71 is supported within interior cavity 14 of housing 11. A bidirectional motor 72 is operatively coupled to controller circuit 50 by a plurality of wires 65. An eccentric cam 74 is rotatably supported by a shaft 73 within drive housing 70. Housing 70 defines a slot 75 at the upper end thereof. A pivot shaft 76 extends through the upper portion of housing 11 and provides the pivot mechanism shown as pivot 23 in FIG. 1. Pivot shaft 76 receives a spring 77 having an end 78 fixedly secured to the upper side of drive housing 70. Spring 77 further includes an elongated end 79 which extends through slot 75 and rests upon the outer surface of cam 74. The elongation of spring end 79 allows end 79 to function as a cam follower.

By means set forth below in conjunction with FIG. 3, motor 72 is operatively coupled to cam 74 to provide rotation thereof during game play activities. The rotation of cam 74 about shaft 73 causes end 79 of spring 77 to move correspondingly in an oscillatory movement. This oscillatory movement of end 79 causes the above-described oscillatory movement of head 22 in the directions indicated by arrows 46.

During game play, a microprocessor 52 supported in combination with other circuit elements such as circuit element 51 cooperates with an internal stored instruction set to allow microprocessor 52 to initiate and maintain game play activities. Correspondingly, microprocessor 52 controls the operation of sound circuit 57 which operates to provide audible sounds heard through speaker 54. As the user plays manipulating toy surfboard 42, joystick post 40 is moved which in turn moves joystick plate 48 actuating various combinations of switches 60 through 63.

By means set forth below in greater detail and better seen in FIG. 3, motor 72 continues to drive cam 74 in its oscillation of head 22 as game play continues. By means also set forth below in greater detail, a losing event at some point may occur during the game play in accordance with the game play rules utilized by microprocessor 52. Under such condition, controller circuit 50 reverses the direction of operation of motor 72. By means set forth below in FIG. 3, the reversal of motor 72 causes the oscillatory movement of head 22 to cease and causes upper jaw 20 and head 22 to rapidly pivot downwardly in the direction indicated by arrow 47 to impact the user's finger upon toy surfboard 42. In accordance with safety constraints and safe operation of the present invention game apparatus, the extent of downward travel permitted by the mechanism operative upon head 22 limits the downward fall to a point which avoids injuring the user's finger.

FIG. 3 sets forth a section view of drive housing 70 and the drive mechanism therein taken along section lines 3—3 in FIG. 2. As described above, drive housing 70 includes an interior cavity 71 and a slot 75. A bidirectional motor 72 is supported within interior cavity 71 and is coupled to controller circuit 50 by a plurality of wires 65. A shaft 81 is rotatably supported within interior cavity 71 and supports a pulley 91 together with a plurality of gears 93, 95 and 97. A shaft 73 is also supported within interior cavity 71 and supports a plurality of gears 94, 96 and 98. Shaft 73 further supports a spring 100 and a cam 74. Cam 74 further includes a chamfered surface 80 and a cylindrical surface 82.

Gear 98 supports a plurality of teeth such as tooth 110 and tooth 105. An additional plurality of teeth are formed on gear 98 but omitted from FIG. 3 to avoid unduly cluttering the figure. The important aspect of the teeth supported upon gear 98 is their shape. Tooth 110 is illustrative of this shape and includes a curved surface 111 and an angled straight edge surface 112. It will be understood that tooth 105 is similarly shaped as are the remaining teeth supported upon gear 98.

Correspondingly, cam 74 supports an identical set of extending teeth which are shaped in the same manner as tooth 110 supported upon gear 98. Thus, by way of illustration, cam 74 is shown supporting a tooth 101 and a tooth 102. Teeth 101 and 102 are illustrative of the plurality of teeth extending from cam 74. Once again, however, it will be understood that additional teeth are supported upon cam 74 which are omitted from FIG. 3 to avoid unduly cluttering the drawing. The essential feature of the teeth extending from cam 74 is the shape thereof. By way of illustration, tooth 102 includes a curved surface 103 and an angled flat surface 104. Thus, the pluralities of teeth supported upon gear 98 and cam 74 extend sufficient distances to contact each other as gear 98 is rotated.

Cam 74 is slidably movable upon shaft 73 and is biased toward the position shown in FIG. 3 by the force of spring 100.

In operation, the rotation of motor 72 in its forward direction rotates pulley 90 and pulley 91 accordingly through the action of belt 92. The engagement of gears 93 through 98 convert the rotation of pulley 91 to a corresponding rotation of gear 98. With motor 72 operating in its forward direction of rotation, gear 98 rotates in the direction indicated by arrow 116. The rotation of gear 98 in the direction indicated by arrow 116 brings the curved surfaces of the teeth upon gear 98 into contact with the curved surfaces of the teeth supported by cam 74. The contact of each curved surface within a contacting tooth pair couples rotational force between gear 98 and cam 74 causing cam 74 to rotate. In addition, the convex curves of the interacting teeth provide a slight outward force against cam 74 assisting spring 100 in maintaining the position of cam 74 as shown in FIG. 3. This position maintains the alignment of spring end 79 upon the outer edge of cam 74 and allows the above-described oscillatory motion to be imparted to pivot shaft 76 which is secured to spring 77.

Conversely, the operation of motor 72 in its reverse direction produces a corresponding reverse direction of rotation of gear 98. This reverse direction of rotation is indicated by arrow 115. Of importance with respect to the present invention is the change in the sides of interacting teeth between gear 98 and cam 74 which results from this reversal of direction. More specifically, the reverse direction rotation of gear 98 brings the angled flat surfaces of each tooth into contact with the angled flat surfaces of the teeth supported by cam 74. The relative angles of interacting edges of the teeth supported by gear 98 and cam 74 imparts rotation of cam 74 in the direction indicated by arrow 115. However and more importantly, the angled surfaces of the interacting teeth produce an additional force which draws cam 74 toward gear 98 overcoming the force of spring 100. This inward movement of cam 74 disturbs the alignment of end 79 upon the outer edge of cam 74 and causes it to slip to chamfered surface 80. The angle of chamfered surface 80 allows end 79 of spring 77 to immediately slip to cylindrical surface 82. Because cylindrical surface 82 is substantially smaller in diameter than the outer edge of cam 74, this movement of end 79 results in the above-described rapid mouth closure for game play apparatus 10. In accordance with safety concerns, the diameter of cylindrical surface 82 is selected to limit the extent of mouth closure to avoid any injury to the user's finger in the game play shown in FIG. 2.

Once the game play is complete and the mouth closure action has been completed, the user may restore the game to its open mouth configuration by terminating game play and once the operation of motor 72 ceases simply pivoting head 22 (seen in FIG. 2) to its upward position. With the termination of operation of motor 72, spring 100 returns cam 74 to its normal position and end 79 again rests upon the outer edge of cam 74. At this point, the present invention game play apparatus is ready for another sequence of game play.

What has been shown is a novel game play apparatus which is suitable for playing a variety of electronic games of the type utilizing microprocessor control and conventional image display such as liquid crystal displays. The novel game apparatus utilizes a joystick providing game play inputs to the game controller and microprocessor together with a motor driven mouth moving apparatus supported upon the upper end of the housing. The apparatus provides for oscillatory motion of the upper jaw and the rapid closure thereof in a game play finale.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A game play apparatus comprising:

a housing defining an interior cavity and an upper portion;

a closure member pivotably supported by said upper portion, said closure member pivotable between an open position and a closed position;

a joystick game play switch mechanism supported by said housing and having an upwardly extending joystick post supporting a finger-touch game play element;

drive means within said interior cavity coupled to said closure member constructed to pivotally oscillate said closure member at said open position and to rapidly move said closure member from said open position to said closed position in close proximity to said finger-touch game play element; and a game play controller responsive to said joystick game play mechanism to cause said drive means to pivotally oscillate said closure member and thereafter move said closure member to said closed position.

2. The game play apparatus set forth in claim 1 wherein said housing includes a lower jaw having a plurality of lower teeth and wherein said closure member includes a head having an upper jaw having a plurality of upper teeth.

3. The game play apparatus set forth in claim 2 wherein said lower jaw includes a mouth interior having an image display.

4. The game play apparatus set forth in claim 3 wherein said head, said upper jaw and said lower jaw are constructed to resemble a shark.

5. The game play apparatus set forth in claim 4 wherein said finger-touch game play element is a miniature toy surfboard.

6. The game play apparatus set forth in claim 5 wherein said drive means include:

a reversible motor;

a cam;

drive means coupling said motor to said cam;

a cam follower coupling said cam to said closure member; and means for displacing said cam follower from said cam to cause said closure member to move to said closed position, said means for displacing being operative in response to a reversal of said motor.

7. The game play apparatus set forth in claim 1 wherein said drive means include:

a reversible motor;

a cam;

drive means coupling said motor to said cam;

a cam follower coupling said cam to said closure member; and means for displacing said cam follower from said cam to cause said closure member to move to said closed position, said means for displacing being operative in response to a reversal of said motor.

8. A game play apparatus for use in combination with a game play controller, said apparatus comprising:

a housing having a lower jaw, a mouth portion and a plurality of lower teeth;

a head pivotably secured to said housing and having an upper jaw and a plurality of upper teeth;

a joystick, supported by said housing, having an upwardly extending joystick post supporting a finger-touch game play element thereon;

drive means within said housing for oscillating said head at an open position and rapidly closing said upper jaw upon said finger-touch game play element in response to said game play controller.

9. The game play apparatus set forth in claim 8 wherein said finger-touch game play element includes a miniature surfboard.

* * * * *